US006129219A

United States Patent [19]

Peickert

[11] Patent Number: 6,129,219

[45] Date of Patent: Oct. 10, 2000

[54] ITEM HOLDER

[76] Inventor: Marlin W. Peickert, 18802 E. Buckskin Dr., Rio Verde, Ariz. 85263

[21] Appl. No.: 09/005,344

[22] Filed: Jan. 9, 1998

Related U.S. Application Data

[63] Continuation-in-part of application No. 08/859,570, May 20, 1997, abandoned.

[51] Int. Cl.[7] ..... A47B 73/00

[52] U.S. Cl. ..... 211/74

[58] Field of Search ..... 211/74, 88.02, 211/126.2, 126.7, 128.1

[56] References Cited

U.S. PATENT DOCUMENTS

| | | |
|---|---|---|
| 1,449,177 | 3/1923 | Harbaugh et al. . |
| 2,103,241 | 12/1937 | Bell . |
| 2,560,161 | 7/1951 | Fay et al. . |
| 3,703,326 | 11/1972 | Riviers . |
| 4,378,889 | 4/1983 | Lebowitz . |
| 4,832,208 | 5/1989 | Finnegan . |

*Primary Examiner*—Alvin Chin-Shue
*Assistant Examiner*—Sarah Purol
*Attorney, Agent, or Firm*—Parsons & Goltry; Robert A. Parsons; Michael W. Goltry

[57] ABSTRACT

For use with a drawer of a type including a continuous sidewall and a closed end having a supporting surface, the continuous sidewall and the supporting surface cooperating to bound a compartment having a length and a width, a support assembly comprising a first support member supportable by the supporting surface, the first support member including a first end, a second end, an engagement element and at least one trough carried intermediate the first and second ends for receiving and supporting one or more items, and a second support member supportable by the supporting surface, the second support member including a first end, a second end, a complemental engagement element and at least one trough carried intermediate the first and second ends thereof for receiving and supporting one or more selected items, the first and second support members engagable in overlapping relation to conform substantially with one of the width and the length of the compartment and to detachably engage the engagement element with the complemental engagement element.

20 Claims, 3 Drawing Sheets

FIG. 1
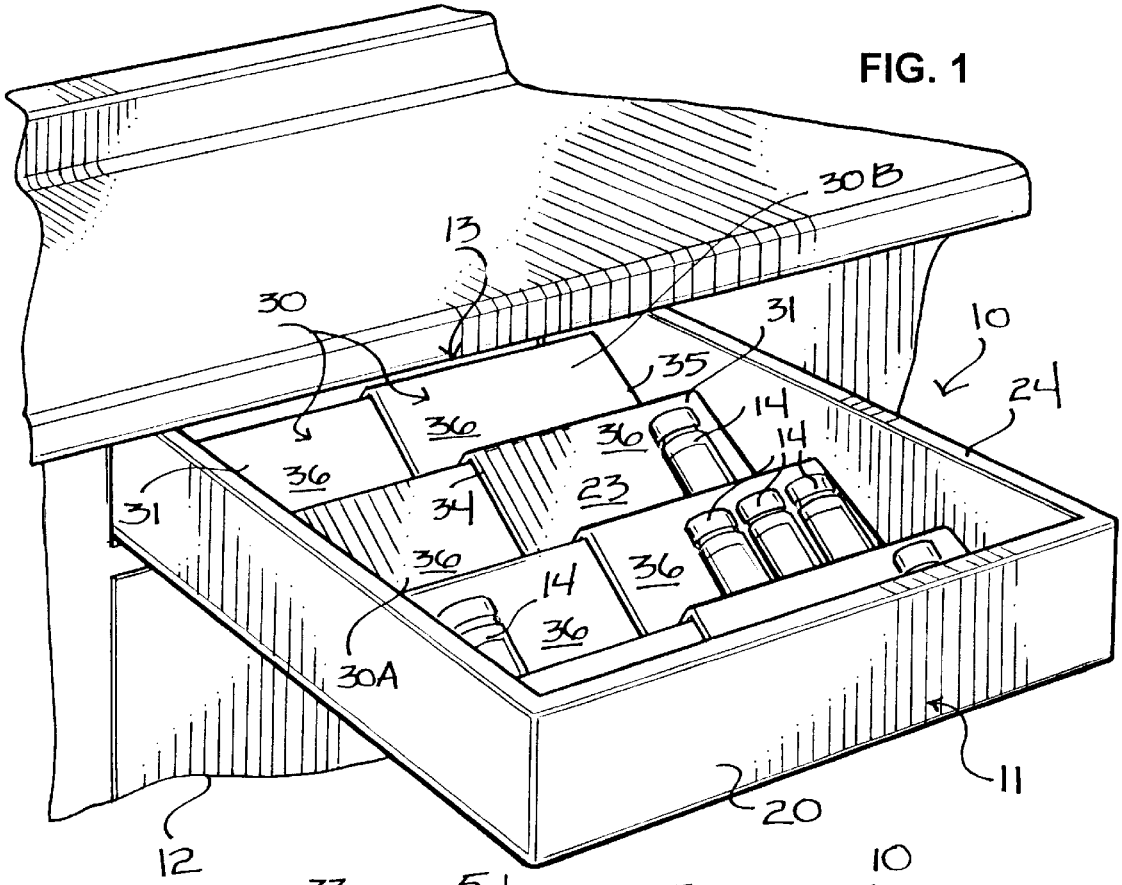
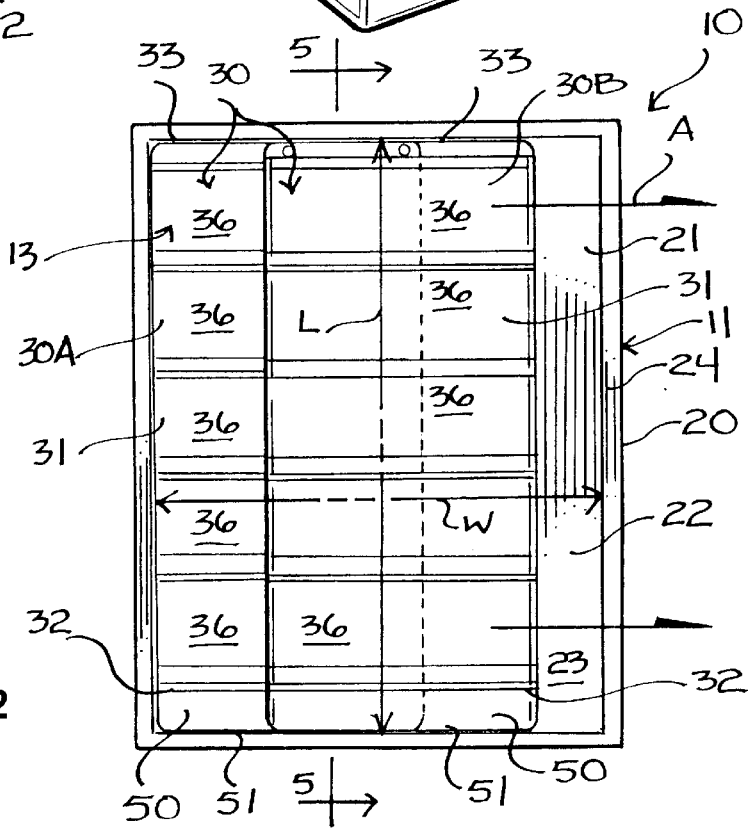
FIG. 2

ITEM HOLDER

The instant application is a continuation-in-part of applicant's copending application, Ser. No. 08/859,570, entitled Consumer Adjustable In Drawer Spice Organizer, filed May 20, 1997 now abandoned.

BACKGROUND OF THE INVENTION

1. Field of the Invention

This invention relates generally to the field of item holders.

More particularly, this invention relates to an adjustable item holder.

In a further and more specific aspect, the present invention relates to an adjustable item holder for holding and storing items in a drawer.

2. Prior Art

The prior art is replete with apparatus for holding, storing and organizing items such as clothing and containers of varying shapes and sizes. Many goods, such as cosmetics, pills, capsules, spices and other items are typically found packaged in substantially cylindrical containers. As a result, the prior art has provided numerous apparatus especially adapted to store the foregoing type of cylindrical container such as storage racks and other similar devices that may be, for instance, mounted on a wall, placed on a countertop and perhaps installed into a drawer. Although exemplary, the prior art item holders for use in combination with drawers are difficult and expensive to construct, and inefficient or unusable for failing to conform substantially to varying shapes and sizes of drawers.

It would be highly advantageous, therefore, to remedy the foregoing and other deficiencies inherent in the prior art.

Accordingly, it is an object of the present invention to provide a new and improved support assembly for holding and storing selected items.

Another object of the present invention is to provide a support assembly that is easy to use.

And another object of the present invention is to provide a support assembly that is easy to construct.

Still another object of the present invention is to provide a support assembly that is inexpensive.

Yet another object of the instant invention is to provide an item holder for use in combination with a drawer of a type including a continuous sidewall and a closed bottom cooperating together to bound a compartment.

Yet still another object of the instant invention is to provide an item holder that is efficient.

And a further object of the invention is the provision of eliminating the frustration of storing and organizing goods of a type provided in small containers.

Still a further object of the immediate invention is to provide an item holder that is adjustable for substantially conforming to drawers of varying sizes and shapes.

Yet a further object of the invention is to provide an item holder for use storing items in drawers that requires no modification to the drawers for proper installation.

And still a further object of the invention is the provision of a new and improved method of storing items.

SUMMARY OF THE INVENTION

Briefly, to achieve the desired objects of the instant invention in accordance with a preferred embodiment thereof, provided is a support assembly for holding and storing selected items. The support assembly is generally comprised of a receptacle including a continuous sidewall and a closed end having a supporting surface, the continuous sidewall and the supporting surface cooperating to bound a compartment having a length and a width.

In a specific example, the support assembly further includes a first support member supportable by the supporting surface, the first support member including a first end, a second end, an engagement element and at least one trough carried intermediate the first and second ends for receiving and supporting one or more items. Further included is a second support member supportable by the supporting surface. The second support member includes a first end, a second end, a complemental engagement element and at least one trough carried intermediate the first and second ends thereof for receiving and supporting one or more selected items. The first and second support members are engagable in overlapping relation to conform substantially with one of the width and the length of the compartment and to detachably engage the engagement element with the complemental engagement element.

In a specific embodiment, the engagement element may include a corrugated surface and the complemental engagement element may include a complemental engagement element. In this regard, the corrugated surface of the first support member may be generally defined by alternating furrows and ridges extending from the first end to the second end thereof, and the complemental corrugated surface of the second support member may be generally defined by complemental alternating furrows and ridges extending from the first end to the second end thereof.

Regarding a preferred embodiment, the first support member and the second support member each include a portion carried by one of the first and second ends, respectively, and removable to a extent as needed to conform first and second support members substantially with one of the length and width of the compartment.

Consistent with the foregoing, associated methods may also be provided.

BRIEF DESCRIPTION OF THE DRAWINGS

The foregoing and further and more specific objects and advantages of the present invention will become readily apparent to those skilled in the art from the following detailed description thereof taken in conjunction with the drawings in which:

FIG. 1 illustrates a perspective view of a support assembly for supporting and storing selected items, the support assembly comprising a receptacle and a plurality of support members for receipt by the receptacle to serve as a support for selected items, in accordance with a preferred embodiment of the present invention;

FIG. 2 illustrates a top plan view of the support assembly of FIG. 1;

DETAILED DESCRIPTION OF THE PREFERRED EMBODIMENT

Figure 3:
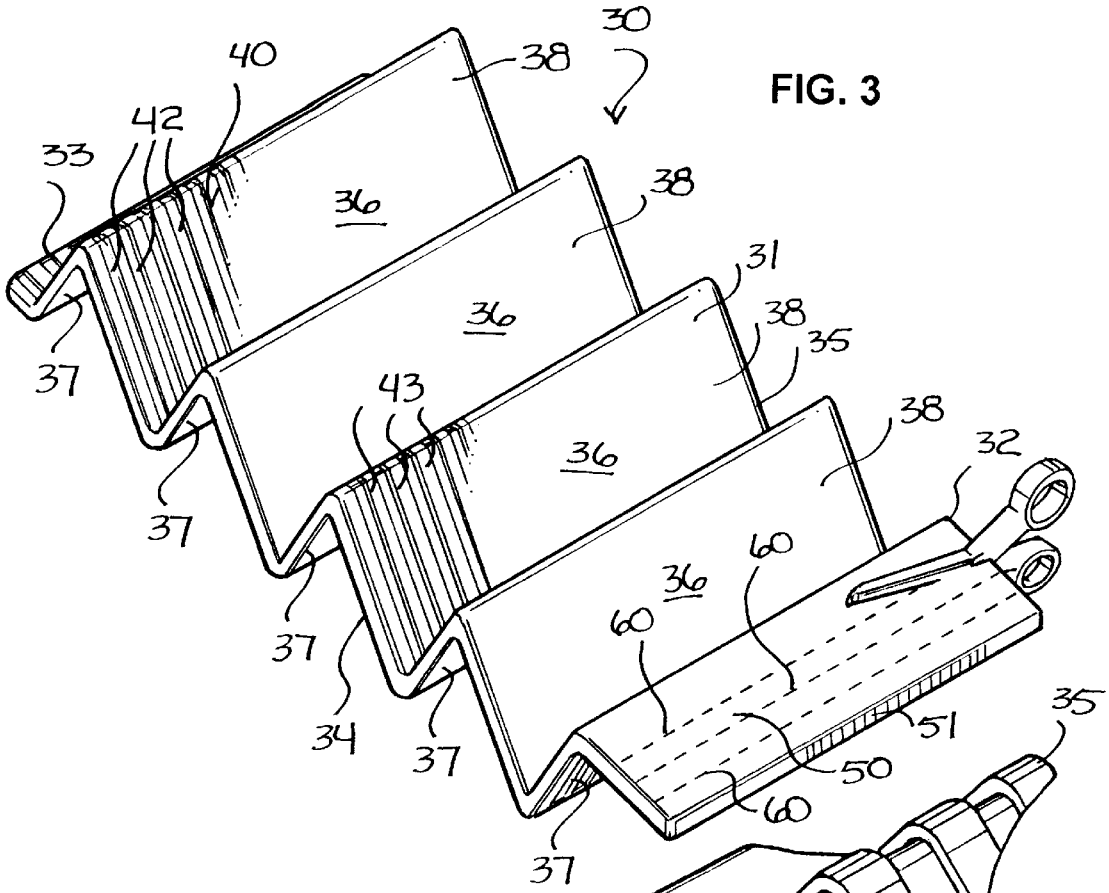
FIG. 3 illustrates a perspective view of one of the plurality of support members first shown in FIG. 1, and further illustrating portions of an end of the support member being removed so as to conform substantially to one of a length and a width of the receptacle of FIG. 1.

The present invention provides, among other things, a support assembly for holding and storing selected items or articles such as substantially cylindrical and noncylindrical storage containers of the type used to carry spices and other food items, cosmetic materials and other non-food items, in addition to other articles as desired. In a further and more specific aspect, the present invention is concerned with providing for the easy and efficient storage of items within a receptacle or drawer.

Turning now to the drawings, in which like reference characters indicate corresponding elements throughout the several views, attention is first directed to FIG. 1 illustrating a perspective view of a support assembly for supporting and storing selected items, the support assembly being generally represented by the reference character 10. Support assembly 10 is generally comprised of a drawer or receptacle 11 of a type that may be found in a chest-of drawers, a desk and, for instance, in cabinetry that may be found in a kitchen, garage or work place such as cabinetry 12 set forth in FIG. 1, etc., and a support assembly 13 carried by receptacle 11 for supporting selected items such as small cylindrical containers and other items each being designated by the reference character 14.

Figure 5:
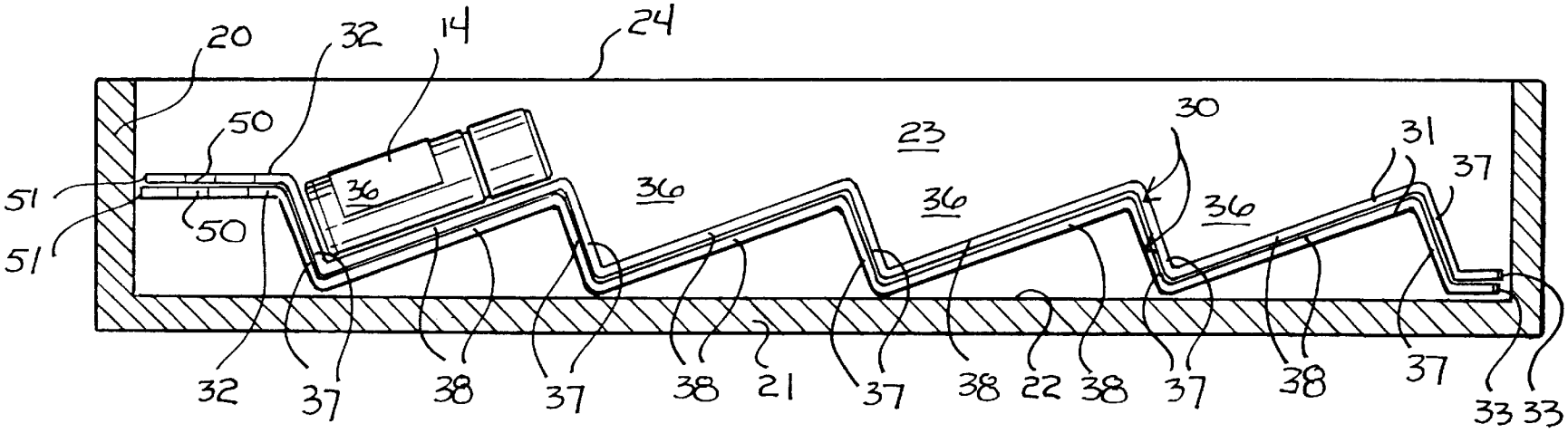
FIG. 5 illustrates a vertical section view taken along line 5—5 of FIG. 2, and further illustrating an item as it would appear carried by one of the plurality of support members.

With continuing reference to FIG. 1 and additional reference to FIG. 2 illustrating a top plan view of support assembly 10 and FIG. 5 illustrating a sectional view taken along line 5—5 of FIG. 2, receptacle 11 is generally comprised of a continuous sidewall 20 including, as shown only in FIGS. 2 and 5, a closed end 21 having a supporting surface 22, continuous sidewall 20 and supporting surface 22 cooperating together to bound a compartment 23 of receptacle 11. Continuous sidewall 20 further includes an open upper end 24 for accessing compartment 23 as desired.

As shown in FIG. 2, compartment 23 is generally intended to include a length L and a width H as substantially shown and defined by continuous sidewall 20. As set forth in FIGS. 1, 2 and 5, receptacle 11 is shown having a substantially rectangular shape. However, receptacle 11 may be provided in other shapes such as round, square, rectangular and other suitable shapes consistent with the teachings herein, all of which are generally intended to be included within the scope of the invention.

Regarding FIG. 1, support assembly 13 is generally comprised of a plurality of support members, each support member being substantially identical and generally designated by the reference character 30. With attention directed to FIG. 3 illustrating a perspective view of one of the support members 30 of FIG. 1, each support member 30 is comprised of a body 31 generally considered to have a first end 32, a second 33 and opposing sides 34 and 35. Preferably constructed of molded plastic, cardboard, wood, a selected metal or other material having similar structural and functional characteristics, body 31 of support member 30 defines a plurality of troughs 36 each generally defined by alternating and interconnected seats 37 and backs 38 carried intermediate first and second ends 33. Regarding the example shown for the purposes of discussion, troughs 36 align in series substantially from first end 32 to second end 33 in substantially parallel relation. Furthermore, seats 37 and backs 38 are preferably substantially planar, normal to each other and define a predetermined and desired angulation to the horizontal for providing each trough 36 substantially as an angularly stepped portion.

Figure 4:
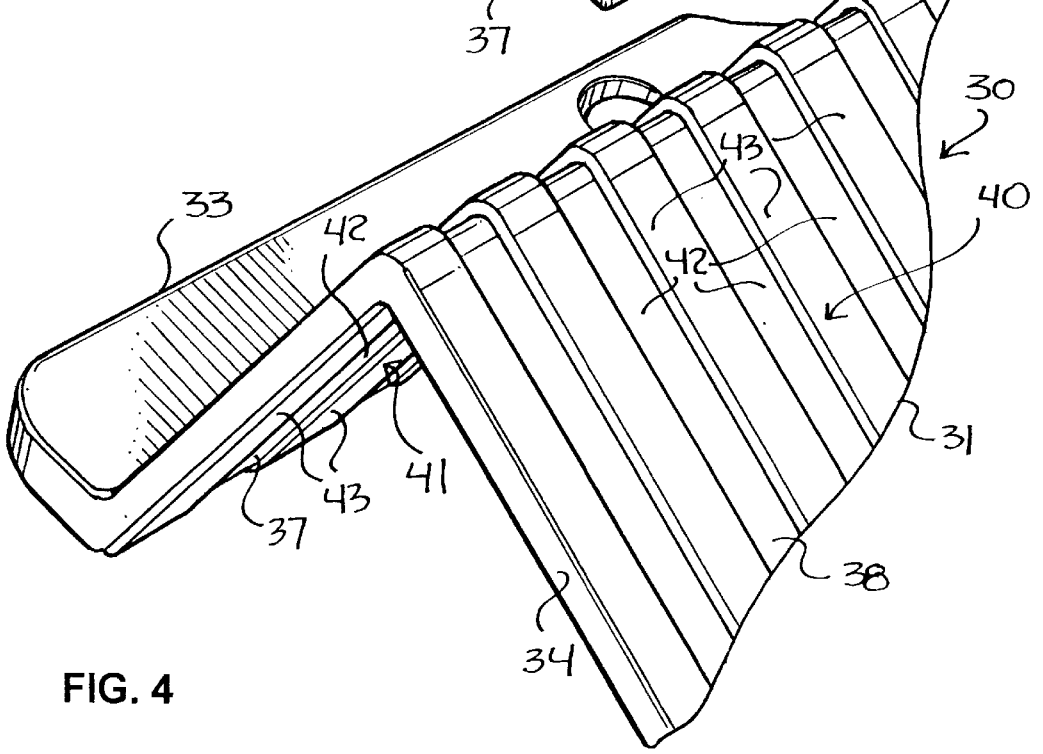
FIG. 4 illustrates an enlarged fragmented perspective view of one of the plurality of support members of FIG. 1.

With momentary attention directed to FIG. 4 illustrating an enlarged fragmented perspective view of one of support members 30, each support member 30 further generally includes a first and second substantially irregular major surfaces generally designated by the reference characters 40 and 41, respectively. Regarding a preferred embodiment, each substantially irregular surface 40 and 41 is defined as a corrugated surface, each corrugated surface including corrugations defined by alternating furrows 42 and ridges 43 that, in this specific example, extend substantially along the entire length of body 31 from first end 32 to second end 33. In an alternate embodiment, furrows 42 and ridges 43 may extend substantially along the entire width of body 31 from side 34 to side 35 if so desired.

Support members 30 are each, either individually or in combination, receivable by receptacle 11 to reside within compartment 23 and to rest upon, or otherwise be supported by, supporting surface 22. So installed, selected items, such as items 14, may be placed to rest against seat 37 and back 38 of one or more of the troughs 36 as desired for meeting the user's storage needs in accordance with intended use. Although the relative length of each support member 30 from first end 32 to second end 33 may be sized to conform substantially to the length L of compartment 23, the length of each support member 30 may be adjusted to conform to a predetermined length L of compartment 23 which may, of course, vary. Furthermore, although the relative width of each support member from side 34 to side 35 may be sized to conform substantially to the width W of compartment 23, by using a predetermined plurality of support members 30, the width of support assembly 13 may be controlled and adjusted as desired to conform to a predetermined width W of compartment which may, like length L, vary. It is important for the length and the width of support assembly to conform substantially to the length L and width W of compartment 23 to prevent support assembly 23 from moving around within compartment 23.

To adjust the length of each support member 30 as needed to conform support assembly 13 substantially to length L of compartment 23, and with attention directed to FIG. 3, each support member 30 may include a spacing element or portion 50 extending outwardly from first end 32 and terminating with a distal end 51. Extending outwardly along substantially the entire width of body 31 and having a substantially planar orientation in the example set forth in FIG. 3, portions of spacing element 50 from first end 32 of body 31 to distal end 51 of spacing element 50 may be removed for adjusting the length of body 31 substantially from first end 32 to second end 33 to conform body 31, as desired, to the length L of compartment 23. To remove portions of spacing element 50, spacing element 50 is preferably constructed of plastic, thin sheet metal, cardboard or other material that may be easily cut, such as with scissors 55, so that desired portions of spacing element may be easily and readily cut or perhaps torn away and removed. In an alternate embodiment, spacing element 50 may be formed with one or more perforate lines 60 for allowing a user to tear away portions of spacing element 50 as needed.

To adjust the width of support assembly 13 as needed to conform substantially to width W of compartment 23, a plurality of support members 30 may be used. To this end, and regarding a preferred embodiment, a pair of support members, herein defined as first and second support members 30A and 30B in FIGS. 1 and 2, may be constructed having a width from side 34 to side 35 somewhat less than width W of compartment 23. In this regard, first and second support members 30A and 30B may be placed to rest upon supporting surface 22 as substantially shown in FIGS. 2 and 5 to engage in overlapping relation to an extent sufficient to cooperate and conform substantially with width W. To this end, and with attention directed to FIG. 2, upon overlapping engagement of support member 30A with support member 30B, support member 30B may be moved horizontally along width W of compartment 23 in the direction indicated by the arrowed line A toward continuous sidewall 20 to an extent necessary for first and second support members 30A and 30B to cooperate and conform substantially to width W of compartment 23 as shown substantially in FIG. 1. So installed, selected items, such as items 14, may be placed to rest within one or more of the troughs 36 as desired for meeting the user's storage needs in accordance with intended use.

With first end second support members 30A and 30B installed in overlapping relation to conform substantially to width W of compartment 23, overlapping and opposing furrows 42 and ridges 43 carried by one of the first and second support members 30A and 30B may receive and detachably engage opposing and overlapping ridges 43 and furrows 42, respectively, carried by the other one of the first and second support members 30A and 30B for facilitating the detachable engagement of the first and second support members 30A and 30B. The detachable engagement of first and second support members 30A and 30B is desirable, in this regard, for maintaining a desired width of support assembly 13 after installation in the manner herein set forth. In this regard, the corrugated surface carried by each support member 30A and 30B are desirably formed to complemental each other to defined an engagement assembly operative for facilitating the detachable engagement of the first and second support members 30A and 30B. Consistent with the nature and scope of the present invention as herein specifically described, substantially irregular surfaces 40 and 41 of, for example, each first and second support member 30A and 30B may be defined by a variety of engagement and complemental engagement mechanisms suitable for providing the detachable engagement of the first and second support members 30A and 30B as herein discussed.

In the overlapped configuration of support members 30, herein delineated as support members 30A and 30B for the purposes of discussion, channels 36 of each support member 30A and 30B will align substantially with corresponding seats 37 and backs 38 of aligned channels 36 to be substantially superimposed relative each other as clearly shown in FIG. 5.

The present invention has been described above with reference to a preferred embodiment. However, those skilled in the art will recognize that changes and modifications may be made in the described embodiments without departing from the nature and scope of the present invention. For instance, although the length of support assembly 13 may be adjusted by removing portions of spacing element 50 of one or more support member 30 to conform substantially with the length L of compartment 23, and although the width of support assembly 13 may be adjusted by overlapping two or more support members 30 together to conform substantially with the width W of compartment 23, these features for adjusting the length and width may be reversed. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is calmed is:

1. A support assembly, comprising:

a receptacle including a continuous sidewall and a closed end having a supporting surface, the continuous sidewall and the supporting surface cooperating to bound a compartment having a width;

a first support member carried by the supporting surface, the first support member including a first end, a second end, a substantially irregular surface and at least one trough carried intermediate the first and second ends for receiving and supporting one or more items and a second support member carried by the supporting surface, the second support member including a first end, a second end, a substantially irregular surface and at least one trough carried intermediate the first and second ends thereof for receiving and supporting one or more selected items, the first and second support members engagable in overlapping relation to adjustably conform substantially with the width of the compartment and to matingly engage the substantially irregular surface of the second support member with the substantially irregular surface of the first support member, the substantially irregular surfaces engaging to prevent relative movement between the first support member and the second support member.

2. The support assembly of claim 1, wherein the substantially irregular surface of the first support member includes a corrugated surface.

3. The support assembly of claim 2, wherein the substantially irregular surface of the second support member includes a complemental corrugated surface.

4. The support assembly of claim 3, wherein the corrugated surface of the first support member includes alternating furrows and ridges extending from the first end to the second end thereof.

5. The support assembly of claim 4, wherein the complemental corrugated surface of the second support member includes complemental alternating furrows and ridges extending from the first end to the second end thereof.

6. The support assembly of claim 1, the compartment further including a length, wherein the first support member and the second support member further include a portion carried by one of the first and second ends thereof and removable to an extent as needed to conform first support member substantially with the length of compartment.

7. The support assembly of claim 1, wherein the at least one trough of the first support member includes an angularly stepped portion.

8. The support assembly of claim 1, wherein the at least one trough of the second support member includes an angularly stepped portion.

9. For use with a drawer of a type including a continuous sidewall and a closed end having a supporting surface, the continuous sidewall and the supporting surface cooperating to bound a compartment having a length and a width, a support assembly, comprising:

a first support member supportable by the supporting surface, the first support member including a first end, a second end, a corrugated surface and at least one trough carried intermediate the first and second ends for receiving and supporting one or more items; and a second support member supportable by the supporting surface, the second support member including a first end, a second end, a corrugated surface and at least one trough carried intermediate the first and second ends thereof for receiving and supporting one or more selected items;

the first and second support members engagable in overlapping relation to conform substantially with one of the width and the length of the compartment and to detachably engage the (engagement element with the complemental engagement element the corrugated surface of the first support member with the corrugated surface of the second support member to prevent relative movement between the first support member and the second support member.

10. The support assembly of claim 9, wherein the corrugated surface of the first support member further includes alternating furrows and ridges extending from the first end to the second end thereof.

11. The support assembly of claim 10, wherein the complemental corrugated surface of the second support member includes complemental alternating furrows and ridges extending from the first end to the second end.

12. The support assembly of claim 9, wherein the first support member and the second support member each include a portion carried by one of the first and second ends, respectively, and removable to a extent as needed to conform first and second support members substantially with one of the length and width of the compartment.

13. The support assembly of claim 9, wherein the at least one trough of the first support member includes an angularly stepped portion.

14. The support assembly of claim 9, wherein the at least one trough of the second support member includes an angularly stepped portion.

15. A method of storing items, the method comprising the steps of:

providing a receptacle including a continuous sidewall and a closed end having a supporting surface, the continuous sidewall and the supporting surface cooperating to bound a compartment having a length and a width;

providing a first support member having a first end, a second end, at least one trough carried intermediate the first and second ends thereof, and a substantially irregular surface;

providing a second support member having a first end, a second end, at least one trough carried intermediate the first and second ends thereof, and a substantially irregular surface;

mounting the first support member with the supporting surface; and mounting the second support member with the supporting surface in overlapping relation with the first support member to an extent sufficient to conform first and second support members substantially with one of the length and the width of the compartment and to matingly engage the substantially irregular surface of the second support member with the substantially irregular surface of the first support member, the substantially irregular surfaces engaging to prevent relative movement between the first support member and the second support member, the at least one trough of the first and second support members, respectively, each for receiving and holding selected items.

16. The method of claim 15, wherein the step of providing a substantially irregular surface of the first support member further includes the step of providing a corrugated surface.

17. The method of claim 16, wherein the step of providing a substantially irregular surface of the second support member further includes the step of providing a complemental corrugated surface.

18. The method of claim 17, wherein the step of providing a corrugated surface further includes the step of providing alternating furrows and ridges extending from the first end to the second end thereof.

19. The method of claim 18, wherein the step of providing a complemental corrugated surface further includes the step of providing complemental alternating furrows and ridges extending from the first end to the second end thereof.

20. The method of claim 15, further including the steps of:

providing the first support member with a spacing element carried by one of the first and second ends thereof;

providing the second support member with a spacing element carried by one of the first and second ends thereof; and removing a portion of each of the spacing elements of the first and second support members to an extent sufficient to conform first and second support members substantially with one of the length and width of the compartment.

* * * * *

UNITED STATES PATENT AND TRADEMARK OFFICE

CERTIFICATE OF CORRECTION

PATENT NO. : 6,129,219
DATED : October 10, 2000
INVENTOR(S) : Marlin Peickert

It is certified that error appears in the above-identified patent and that said Letters Patent is hereby corrected as shown below:

Column 7,
Line 4, delete "(engagement element with the complemental engagement element".

Signed and Sealed this

Fourth Day of December, 2001

*Attest:*

Nicholas P. Godici

NICHOLAS P. GODICI
*Acting Director of the United States Patent and Trademark Office*

*Attesting Officer*